US010944184B2

(12) United States Patent
Shi et al.

(10) Patent No.: US 10,944,184 B2
(45) Date of Patent: Mar. 9, 2021

(54) SLOT ARRAY ANTENNA INCLUDING PARASITIC FEATURES

(71) Applicant: Aptiv Technologies Limited, St. Michael (BB)

(72) Inventors: Shawn Shi, Thousand Oaks, CA (US); Mingjian Li, Agoura Hills, CA (US)

(73) Assignee: Aptiv Technologies Limited, St. Michael (BB)

( * ) Notice: Subject to any disclaimer, the term of this patent is extended or adjusted under 35 U.S.C. 154(b) by 0 days.

(21) Appl. No.: 16/294,528

(22) Filed: Mar. 6, 2019

(65) Prior Publication Data

US 2020/0287293 A1 Sep. 10, 2020

(51) Int. Cl.

| | |
|---|---|
| ***H01Q 21/06*** | (2006.01) |
| ***H01P 3/12*** | (2006.01) |
| ***H01Q 13/10*** | (2006.01) |
| ***H01Q 21/00*** | (2006.01) |

(52) U.S. Cl.

CPC ..... *H01Q 21/064* (2013.01); *H01P 3/121* (2013.01); *H01Q 13/10* (2013.01); *H01Q 21/0093* (2013.01)

(58) Field of Classification Search

CPC .. H01P 3/12; H01P 3/121; H01P 3/122; H01P 3/123; H01Q 21/0093; H01Q 21/06; H01Q 21/064; H01Q 21/08; H01Q 21/12; H01Q 13/10; H01Q 13/106

See application file for complete search history.

(56) References Cited

U.S. PATENT DOCUMENTS

| | | | | |
|---|---|---|---|---|
| 4,291,312 | A * | 9/1981 | Kaloi | H01Q 1/48 343/700 MS |
| 5,047,738 | A * | 9/1991 | Wong | H01P 5/182 333/113 |
| 8,576,023 | B1 * | 11/2013 | Buckley | H01Q 15/0086 333/26 |
| 9,882,288 | B2 * | 1/2018 | Black | H01Q 23/00 |
| 10,186,787 | B1 * | 1/2019 | Wang | H01Q 13/10 |
| 10,613,216 | B2 * | 4/2020 | Vacanti | H01Q 1/287 |
| 2007/0103381 | A1 * | 5/2007 | Upton | H01Q 19/067 343/909 |

(Continued)

FOREIGN PATENT DOCUMENTS

| | | |
|---|---|---|
| EP | 2267841 | 12/2010 |
| KR | 101092846 | 12/2011 |

OTHER PUBLICATIONS

"Extended European Search Report", EP Application No. 20155296.5, dated Jul. 13, 2020, 12 pages.

*Primary Examiner* — Jason Crawford
(74) *Attorney, Agent, or Firm* — Colby Nipper PLLC

(57) ABSTRACT

An illustrative example antenna device includes a substrate. A plurality of conductive members in the substrate establish a substrate integrated waveguide. A plurality of first and second slots are on an exterior surface of a first portion of the substrate. Each of the second slots is associated with a respective one of the first slots. The first and second slots are configured to establish a radiation pattern that varies across a beam of radiation emitted by the antenna device. A plurality of parasitic interruptions include slots on the exterior surface of a second portion of the substrate. The parasitic interruptions reduce ripple effects otherwise introduced by adjacent antennas.

21 Claims, 3 Drawing Sheets

(56) References Cited

U.S. PATENT DOCUMENTS

| | | | | |
|---|---|---|---|---|
| 2011/0181482 | A1* | 7/2011 | Adams | H01Q 13/18 343/771 |
| 2012/0056776 | A1 | 3/2012 | Shijo et al. | |
| 2012/0194399 | A1* | 8/2012 | Bily | H01Q 15/0006 343/772 |
| 2012/0280770 | A1* | 11/2012 | Abhari | H01P 1/184 333/209 |
| 2013/0082801 | A1* | 4/2013 | Rofougaran | H01L 23/66 333/239 |
| 2013/0300602 | A1* | 11/2013 | Zhou | H01Q 21/005 221/5 |
| 2016/0056541 | A1* | 2/2016 | Tageman | H01P 3/16 343/771 |
| 2016/0195612 | A1 | 7/2016 | Shi | |
| 2017/0012335 | A1* | 1/2017 | Boutayeb | H01P 1/15 |
| 2017/0288313 | A1 | 10/2017 | Chung et al. | |
| 2018/0123245 | A1* | 5/2018 | Papio Toda | H01Q 21/0075 |
| 2018/0301820 | A1* | 10/2018 | Bregman | H01Q 13/10 |
| 2019/0057945 | A1* | 2/2019 | Maaskant | H01Q 13/10 |
| 2019/0109361 | A1* | 4/2019 | Ichinose | H01P 3/123 |
| 2019/0115644 | A1* | 4/2019 | Wang | H01P 5/184 |
| 2019/0260137 | A1* | 8/2019 | Watanabe | H01Q 5/42 |
| 2020/0076086 | A1* | 3/2020 | Cheng | H01Q 9/0421 |
| 2020/0106171 | A1* | 4/2020 | Shepeleva | H01Q 21/064 |

* cited by examiner

SLOT ARRAY ANTENNA INCLUDING PARASITIC FEATURES

BACKGROUND

Increasing amounts of technology are included on automotive vehicles. Radar and lidar sensing devices provide the capability to detect objects in a vicinity or pathway of the vehicle. Many such devices include a radiating antenna that emits the radiation used for object detection.

While different antenna types have proven useful, they are not without shortcomings or drawbacks. For example, some antennas that are useful for short or medium range detection have the capability of covering a wide field of view, but experience high loss when the electromagnetic wave radiated from the antenna passes through the fascia of the vehicle. Such high losses are typically associated with vertical polarization of the antenna. One attempt to address that problem is to incorporate horizontal polarization. The difficulty associated with horizontal polarization, however, is that the impedance bandwidth is typically too narrow to satisfy production requirements. One approach to increase the impedance bandwidth includes increasing the thickness of the antenna substrate material. A disadvantage associated with that approach is that it increases cost.

Another difficulty associated with some known radar antenna configurations is the occurrence of high frequency ripples resulting from radiation scattering from nearby antennas, electronic components on the vehicle, and other metal or dielectric materials in close proximity to the antennas. A further complication is that the ripples in the radiation pattern for each antenna occur at different angles and that affects the uniformity of the radiation patterns of all the antennas used for radar. A non-uniform radiation pattern significantly lowers the angle finding accuracy of the radar system.

SUMMARY

An illustrative example antenna device includes a substrate. A plurality of conductive members in the substrate establish a substrate integrated waveguide (SIW). A first portion of the substrate is within the SIW and a second portion of the substrate is outside the SIW. A plurality of first slots are on an exterior surface of the first portion of the substrate. A plurality of second slots are also on the exterior surface of the first portion of the substrate. Each of the second slots is associated with a respective one of the first slots. The first and second slots are configured to establish a radiation pattern that varies across a beam of radiation emitted by the antenna device. A plurality of parasitic interruptions include at least a first one of the parasitic interruptions on a first side of the SIW and at least a second one of the parasitic interruptions on a second, opposite side of the SIW.

In an example embodiment having one or more features of the antenna device of the previous paragraph, the parasitic interruptions respectively include a slot along an exterior surface of the second portion of the substrate, and at least one conductive connector establishing a conductive connection between the exterior surface of the second portion near two sides of the slot and a conductive layer near an opposite side of the substrate.

In an example embodiment having one or more features of the antenna device of any of the previous paragraphs, the at least one conductive connector comprises a plurality of conductive members.

In an example embodiment having one or more features of the antenna device of any of the previous paragraphs, the parasitic interruption slots have a depth corresponding to one-quarter of a guided wavelength.

In an example embodiment having one or more features of the antenna device of any of the previous paragraphs, the parasitic interruption slots are lined with a conductive material.

In an example embodiment having one or more features of the antenna device of any of the previous paragraphs, the conductive material comprises metal and the conductive layer near the opposite side of the substrate comprises metal.

In an example embodiment having one or more features of the antenna device of any of the previous paragraphs, the metal is copper.

In an example embodiment having one or more features of the antenna device of any of the previous paragraphs, the first slots emit radiation having a first characteristic and the second slots emit radiation having a second characteristic that is different than the first characteristic.

In an example embodiment having one or more features of the antenna device of any of the previous paragraphs, the first and second characteristics respectively comprise at least one of a power of emitted radiation, a phase of emitted radiation, or a gain of emitted radiation.

In an example embodiment having one or more features of the antenna device of any of the previous paragraphs, the first characteristic and the second characteristic bias a gain of the beam of radiation toward one side of the radiation pattern.

In an example embodiment having one or more features of the antenna device of any of the previous paragraphs, the first slots have a first length, the second slots have a second length, and the first and second characteristics are based on the first and second lengths, respectively.

In an example embodiment having one or more features of the antenna device of any of the previous paragraphs, a spacing between associated first and second slots varies along a length of the SIW.

In an example embodiment having one or more features of the antenna device of any of the previous paragraphs, the spacing controls a strength of radiation emitted through the associated first and second slots.

In an example embodiment having one or more features of the antenna device of any of the previous paragraphs, the substrate includes a plurality of SIWs, at least a first one of the parasitic interruptions is on a first side of each SIW, and at least a second one of the parasitic interruptions is on a second, opposite side of each SIW.

In an example embodiment having one or more features of the antenna device of any of the previous paragraphs, each SIW includes an input port between opposite ends of the SIW, at least some of the parasitic interruptions are on one side of a respective one of the input ports, and at least some others of the parasitic interruptions are on a different side of the respective one of the input ports.

In an example embodiment having one or more features of the antenna device of any of the previous paragraphs, the SIWs are aligned parallel to each other, the parasitic interruptions are parallel to the SIWs, an input port to at least one of the SIWs is situated between adjacent SIWs; and at least some of the parasitic interruptions are situated between adjacent SIWs.

In an example embodiment having one or more features of the antenna device of any of the previous paragraphs, a number of the parasitic interruptions on the first side of the SIW differs from a number of the parasitic interruptions on the second side of the SIW.

In an example embodiment having one or more features of the antenna device of any of the previous paragraphs, the exterior surface comprises a layer of metal.

An illustrative example of a method of making an antenna device includes: establishing a plurality of first slots on an exterior surface of a first portion of a substrate, the substrate including a substrate integrated waveguide (SIW), the first portion of the substrate being within the SIW and a second portion of the substrate being outside the SIW; establishing a plurality of second slots on the exterior surface of the first portion of the substrate, each of the second slots being associated with a respective one of the first slots, the first and second slots being configured to establish a radiation pattern that varies across a beam of radiation emitted by the antenna device; and establishing a plurality of parasitic interruptions, at least a first one of the parasitic interruptions being on a first side of the SIW and at least a second one of the parasitic interruptions being on a second, opposite side of the SIW.

In an example embodiment having one or more features of the method of the previous paragraph, the exterior surface comprises a first conductive layer. Establishing the parasitic interruptions, respectively, includes forming a slot along an exterior surface of the second portion of the substrate, lining the formed slot with a conductive material, and establishing a conductive connection between the exterior surface of the second portion near two sides of the slot and a conductive layer near an opposite side of the substrate.

Various features and advantages of at least one disclosed example embodiment will become apparent to those skilled in the art from the following detailed description. The drawings that accompany the detailed description can be briefly describe as follows.

DETAILED DESCRIPTION

Figure 1:
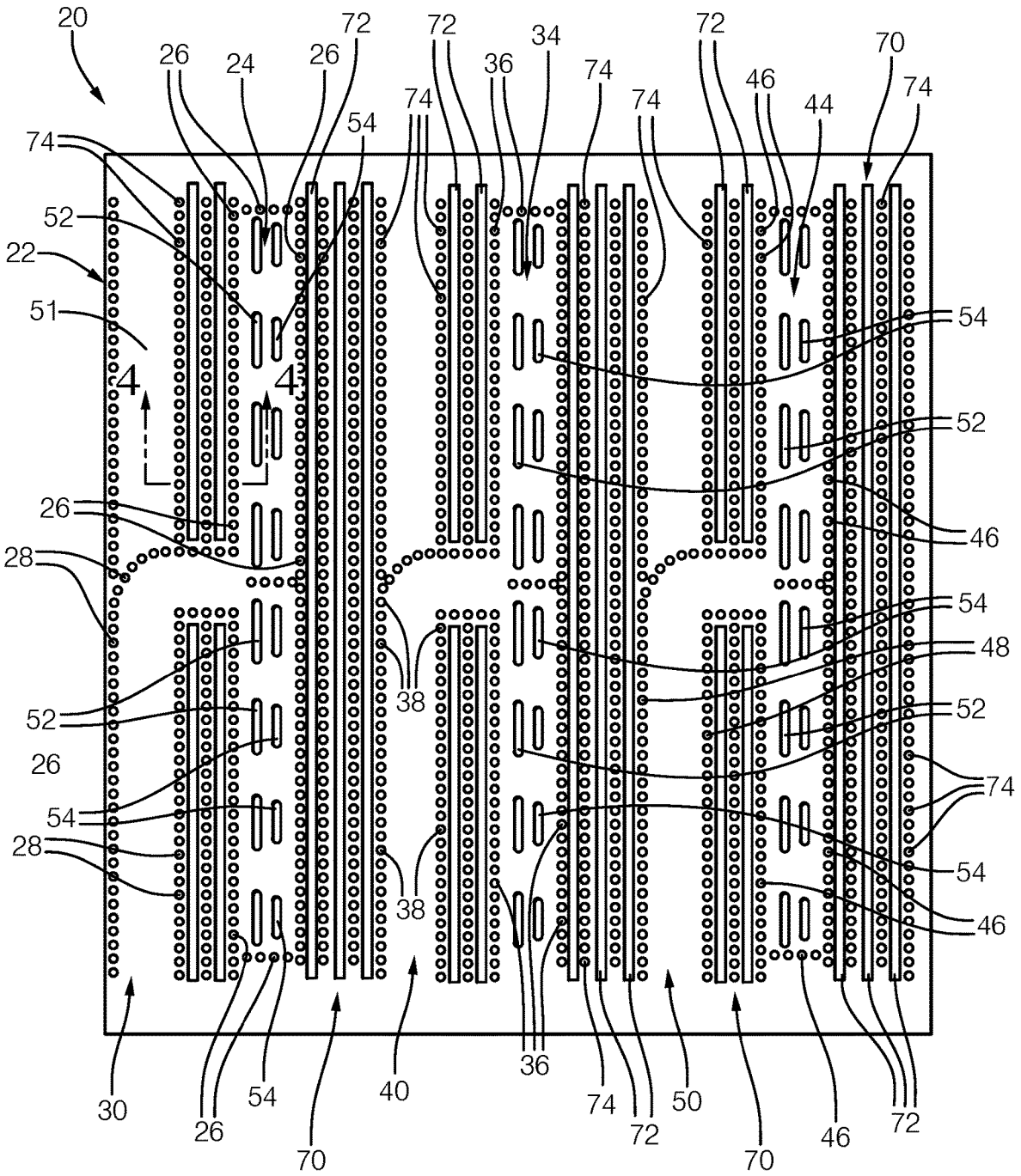
FIG. 1 schematically illustrates an example embodiment of an antenna device.

FIG. 1 schematically shows an example embodiment of an antenna device 20. A substrate 22 includes a plurality of substrate integrated waveguides (SIWs). A first SIW 24 is established between conductive members 26, which are conductive vias in this example. Conductive members 28, which are also conductive vias in this example, establish a first input port 30 of the first SIW 24. A second SIW 34 is established between conductive members 36. Conductive members 38 establish a second input port 40 into the second SIW 34. A third SIW 44 defined between conductive members 46 is included in the illustrated example. Conductive members 48 establish a third input port 50 for the third SIW 44. In this example, all of the conductive members 36, 38, 46 and 48 are conductive vias.

The portions of the substrate 22 within the SIWs 24, 34 and 44 are each referred to as a first portion of the substrate 22. The other portion of the substrate 22 outside of the SIWs is referred to as a second portion of the substrate 22.

An exterior surface 51 of the substrate 22 includes a layer of electrically conductive material. In this example, the exterior surface 51 includes metal, such as copper. The exterior surfaces of the first portions of the substrate 22 include a plurality of first slots 52 and a plurality of second slots 54. The first slots 52 and the second slots 54 allow energy within the respective SIWs to radiate out through the slots 52 and 54. Each SIW with its slots 52 and 54 operates as an antenna.

The first slots 52 emit radiation that has a different characteristic than the radiation emitted through the second slots 54. The characteristic that differs may be any of a power, phase or gain of the radiation. In the illustrated example, the different characteristic is a result of the different sizes of the first slots 52 compared to the second slots 54.

Figure 2:
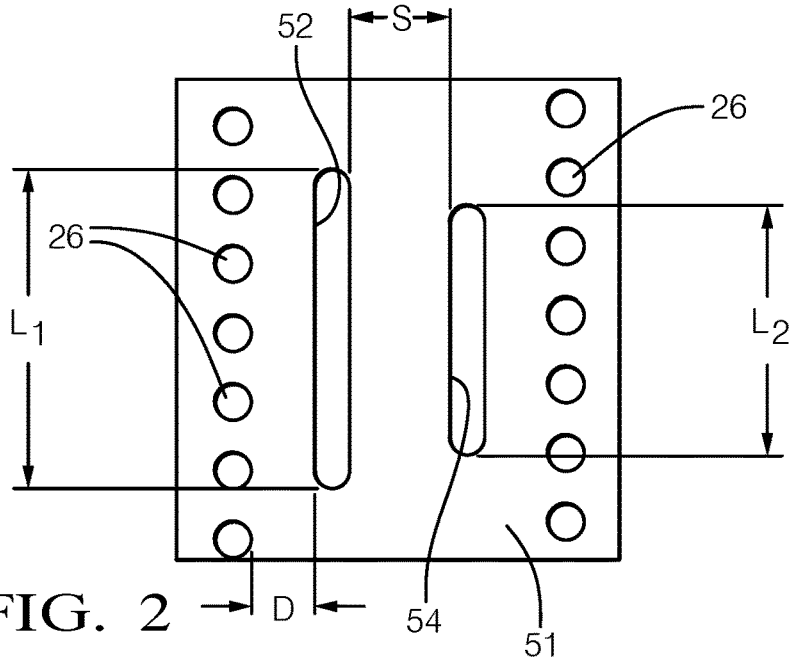
FIG. 2 illustrates selected features of the embodiment of FIG. 1.

Each of the second slots 54 is associated with one of the first slots 52. FIG. 2 shows an example set of a first slot 52 and an associated second slot 54. The first slot 52 has a first length $L_1$ that is longer than a second length $L_2$ of the second slot 54. All first slots 52 are longer than their associated second slot 54 in the illustrated example. The different lengths $L_1$ and $L_2$ provide a radiation pattern that varies across a beam of radiation emitted by each SIW antenna. The different lengths result in different phases of the radiation and the arrangement of the first slots 52 along one side of the SIW and the second slots 54 along another side of the SIW provides a phase tilt that biases a gain of the radiation from the SIW antenna toward one side.

Figure 3:
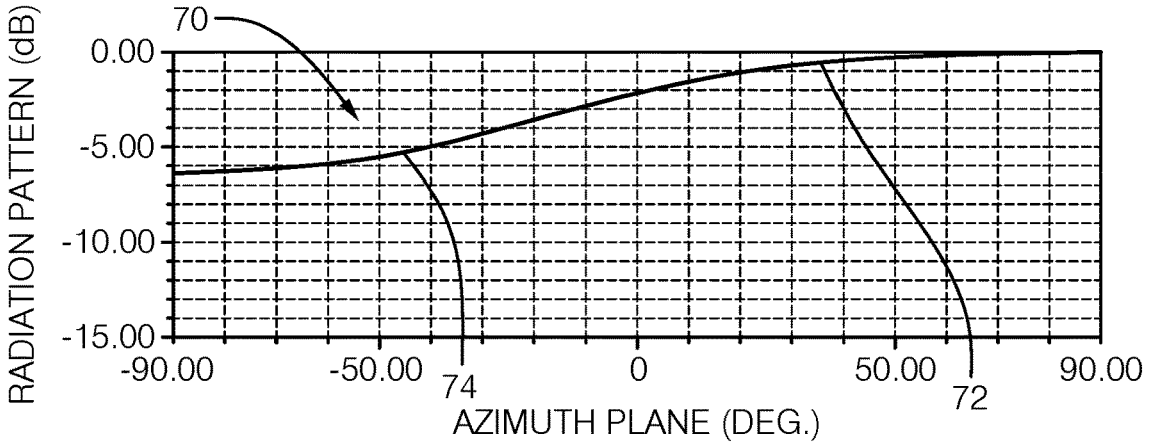
FIG. 3 graphically illustrates an example radiation pattern emitted by an example embodiment of an antenna device.

FIG. 3 includes a plot 60 of a gain of a radiation pattern across an example beam of radiation. At 62, the gain is higher than at 64 and is biased toward one side of the beam. Such a radiation pattern makes the example embodiment useful for middle range radar, for example, and provides a narrow elevation angle with a wide range azimuth angle over significant distances. Having the gain biased to one side like the example of FIG. 3 allows for strategically placing a plurality of antenna devices 20 on a vehicle, for example, to achieve a desired sensing or detecting radiation pattern around the periphery of the vehicle.

The associated first and second slots 52 and 54 are spaced apart by a spacing S. The spacing S varies along a length of the corresponding SIW. The spacing S is smaller near the input to the SIW and the ends of the SIW compared to the spacing between other associated first and second slots 52 and 54. The different spacings between the associated first slots 52 and second slots 54 accompanies a different distance between the respective slots 52 and 54 and the conductive members 26, 36, or 46 that establish the boundaries of the SIW. That distance shown at D in FIG. 2 influences a strength of the radiation from the corresponding slots. A smaller distance D provides stronger radiation. Varying the spacing S and the distance D along a length of the SIWs achieves a desired tapering of the beam of radiation. In the illustrated example, the beam of radiation tapers off near the edges of the beam.

The example embodiment of FIG. 1 includes a plurality of parasitic interruptions 70 that minimize or eliminate interference or coupling between the SIW antennas. The parasitic interruptions 70 are also useful for reducing interference otherwise caused by other devices near the antenna device 20. The parasitic interruptions 70 include slots 72 in the exterior surface 51 of the second portion of the substrate outside of the SIWs. The slots 72 have a depth that corresponds to one-quarter of guided wavelength. The parasitic interruptions 70 also include a plurality of conductive connectors 74 on opposite sides of the slots 72.

Figure 4:
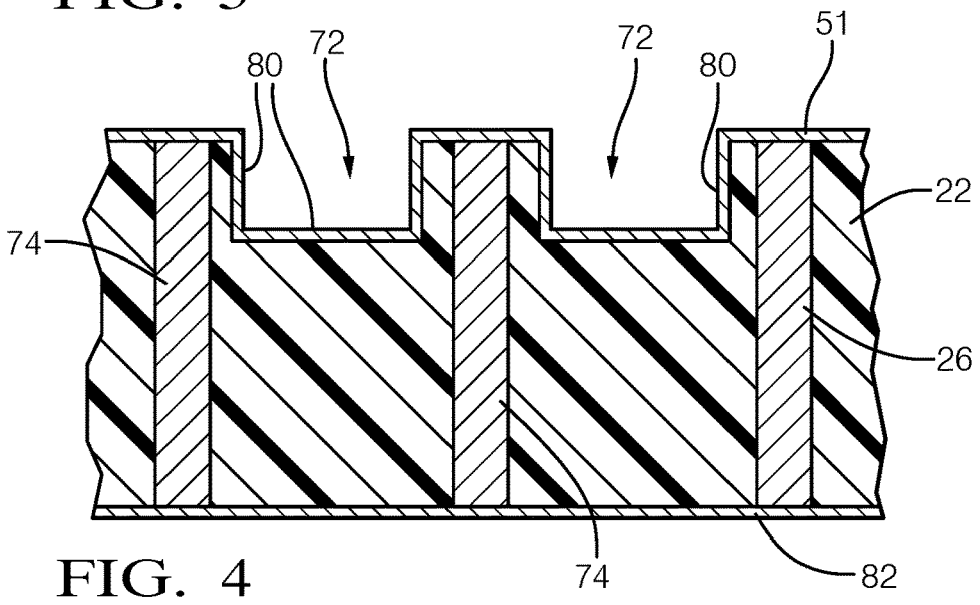
FIG. 4 is a cross-sectional illustration taken along the lines 4-4 in FIG. 1.

As shown in FIG. 4, the slots 72 have a conductive coating or lining 80. In this example, the conductive lining 80 comprises a layer of metal, such as copper. The conductive connectors 74 establish a conductive connection between the exterior layer 51 and another conductive layer 82 that is near an opposite side of the substrate 22. In this example, the conductive layer 82 establishes or defines an exterior surface of the opposite side of the substrate 22 and operates as a ground layer.

The conductive connectors 74 in this example are conductive vias. The conductive connectors 74 establish conductive fences that form or establish sides of a choke including the slot 72 between two rows of the conductive connectors 74. Some of the slots have the conductive connectors 74 on one side and the conductive members 26, 36 or 46 of one side of the adjacent SIW on the other side of the slot 72. The example shown in FIG. 4 includes two of the slots 72 situated on the left (according to FIG. 1) of the SIW 24 and the conductive members 26 also serve as conductive connectors to establish or define one side of one of the chokes shown in FIG. 4. Some of the example chokes of the parasitic interruptions 70 include the conductive members 28, 38, 48 that respectively establish the input ports 30, 40 and 50 as at least some of the conductive connectors on a side of one of the slots 72. The slots 72 and the conductive connectors 74 (and in some instances the conductive members 26, 28, 36, 38, 46, or 48) establish the chokes having generally U-shaped metal surface cross-sections between the SIW antennas that reduce antenna coupling. The chokes interrupt electrical energy or current flow along the exterior surface 51.

As shown in FIG. 1 there are different numbers of parasitic interruptions 70 on two sides of the SIWs based on the number of slots 72 on each side. Given the biased gain of the example SIW antennas, the different numbers of slots are situated to address the way in which energy may otherwise travel along the exterior surface 51 and result in coupling between the SIW antennas.

Figure 5:
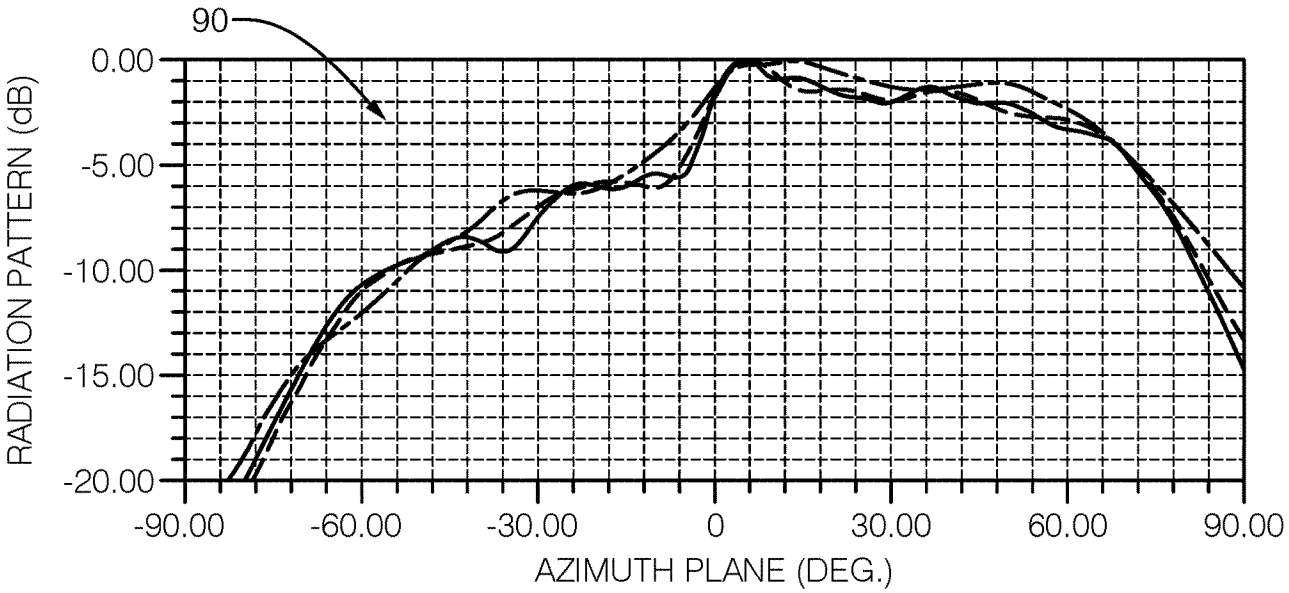
FIG. 5 graphically illustrates an example radiation pattern emitted by the embodiment of FIG. 1.
Figure 6:
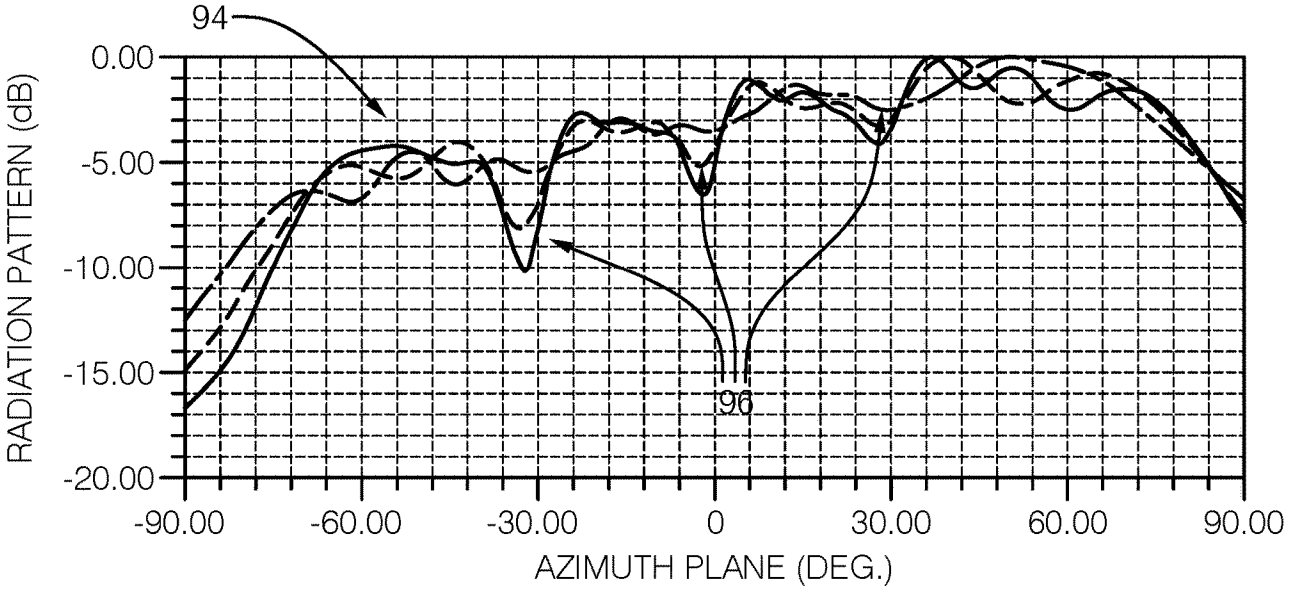
FIG. 6 graphically illustrates an example radiation pattern that may result if features of the embodiment of FIG. 1 were not present.

The parasitic interruptions 70 ensure a desired profile or smoothness of the radiation pattern of the individual antennas of the antenna device 20. FIG. 5 shows a desirable radiation pattern across three beams corresponding to an output beam of radiation from each of the SIW antennas. If the parasitic interruptions were not present, then there would be coupling between the SIW antennas and a resulting radiation pattern would be like that shown at 94 in FIG. 6. The coupling has the effect of causing dips, as shown at 96, in the radiation pattern, which is undesirable. The parasitic interruptions 70 guard against such dips. Additionally, the parasitic interruptions 70 allow for more antenna devices 20 to be situated near each other to provide wide radiation beam coverage from each antenna, which allows for more comprehensive and consistent scanning or detecting around the periphery or exterior of a vehicle.

The preceding description is illustrative rather than limiting in nature. Variations and modifications to the disclosed example embodiments may become apparent to those skilled in the art without departing from the essence of this invention. The scope of legal protection provided to this invention can only be determined by studying the following claims.

We claim:

1. An antenna device, comprising:

a substrate;

a plurality of conductive members in the substrate, the conductive members establishing a substrate integrated waveguide (SIW), a first portion of the substrate being within the SIW and a second portion of the substrate being outside the SIW;

a plurality of first slots on an exterior surface of the first portion of the substrate;

a plurality of second slots on the exterior surface of the first portion of the substrate, each of the second slots being associated with a respective one of the first slots, the first and second slots being configured to establish a radiation pattern that varies across a beam of radiation emitted by the antenna device; and a plurality of parasitic interruptions, at least a first one of the parasitic interruptions being on a first side of the SIW and at least a second one of the parasitic interruptions being on a second, opposite side of the SIW, the first one of the parasitic interruptions having a first set of one or more first parasitic-interruption slots and the second one of the parasitic interruptions having a second set of one or more second parasitic-interruption slots, the first set and the second set having:

a different number of respective parasitic-interruption slots;

different lengths of respective parasitic-interruption slots; or different respective continuities.

2. The antenna device of claim 1, wherein the parasitic interruptions respectively comprise:

at least one conductive connector establishing a conductive connection between an exterior surface of the second portion near two sides of the first parasitic-interruption slots and a conductive layer near an opposite side of the substrate.

3. The antenna device of claim 2, wherein the first or second parasitic-interruption slots have a depth corresponding to one-quarter of a guided wavelength.

4. The antenna device of claim 1, wherein the first slots emit radiation having a first characteristic; and the second slots emit radiation having a second characteristic that is different than the first characteristic, the first characteristic and the second characteristic biasing a gain of the beam of radiation toward one side of the radiation pattern.

5. The antenna device of claim 4, wherein the first slots have a first length;

the second slots have a second length; and the first and second characteristics are based on the first and second lengths, respectively.

6. The antenna device of claim 1, wherein the substrate includes a plurality of SIWs;

at least a first one of the parasitic interruptions is on a first side of each SIW; and at least a second one of the parasitic interruptions is on a second, opposite side of each SIW.

7. The antenna device of claim 6, wherein each SIW includes an input port between opposite ends of the SIW;

at least some of the parasitic interruptions are on one side of a respective one of the input ports; and at least some others of the parasitic interruptions are on a different side of the respective one of the input ports.

8. The antenna device of claim 6, wherein the SIWs are aligned parallel to each other;

the parasitic interruptions are parallel to the SIWs;

an input port to at least one of the SIWs is situated between adjacent SIWs; and at least some of the parasitic interruptions are situated between adjacent SIWs.

9. The antenna device of claim 1, wherein the first set and the second set have the different number of respective parasitic-interruption slots.

10. The antenna device of claim 1, wherein the first set and the second set have the different lengths of the respective parasitic-interruption slots.

11. The antenna device of claim 1, wherein the first set and the second set have the different respective continuities, the one or more first parasitic-interruption slots of the first set being discontinuous along the first side of the SIW and the one or more second parasitic-interruption slots of the second set being continuous along the second, opposite side of the SIW.

12. The antenna device of claim 1, wherein each of the plurality of the first slots on the exterior surface of the first portion of the substrate are longer than each of the plurality of the second slots on the exterior surface of the first portion.

13. The antenna device of claim 1, wherein each of the plurality of the first slots on the exterior surface of the first portion of the substrate has an associated one of the plurality of the second slots on the exterior surface of the first portion, each of the first slots having outer bounds along a length that extend past outer bounds along a length of the second slots relative to a plane perpendicular to the lengths of the first slots and the second slots.

14. The antenna device of claim 1, wherein each of the plurality of the first slots on the exterior surface of the first portion of the substrate has an associated one of the plurality of the second slots on the exterior surface of the first portion, each of the first slots and the second slots having a spacing between each of the respective associated slots, the spacing varying between at least two of each of the spacings between the respective slots.

15. The antenna device of claim 14, wherein the spacings are smaller near an input to the SIW.

16. The antenna device of claim 14, wherein the spacings are smaller at ends of the SIW.

17. The antenna device of claim 1, wherein each of the plurality of the first slots on the exterior surface of the first portion of the substrate include spacings from the plurality of conductive members of the substrate.

18. The antenna device of claim 17, wherein the spacings vary along the SIW, the variation effective to enable stronger radiation from smaller of the spacings relative to weaker radiation from larger of the spacings.

19. The antenna device of claim 18, wherein the variation is effective to achieve a tapering of the beam of radiation emitted by the antenna device.

20. The antenna device of claim 1, wherein the plurality of first slots include lengths that are substantially parallel, and where the lengths of the first slots are substantially parallel to the first parasitic-interruption slots or the second parasitic-interruption slots.

21. The antenna device of claim 20, wherein the plurality of second slots include lengths that are substantially parallel, and where the lengths of the second slots are substantially parallel to the lengths of the first slots and the first parasitic-interruption slots or the second parasitic-interruption slots.

* * * * *